US008151685B2

(12) United States Patent
Joynt

(10) Patent No.: US 8,151,685 B2
(45) Date of Patent: Apr. 10, 2012

(54) APPARATUS FOR DEFEATING HIGH ENERGY PROJECTILES

(75) Inventor: Vernon P. Joynt, Pretoria (ZA)

(73) Assignee: Force Protection Industries, Inc., Ladson, SC (US)

( * ) Notice: Subject to any disclaimer, the term of this patent is extended or adjusted under 35 U.S.C. 154(b) by 965 days.

(21) Appl. No.: 11/521,307

(22) Filed: Sep. 15, 2006

(65) Prior Publication Data

US 2011/0303079 A1 Dec. 15, 2011

(51) Int. Cl.
*F41H 5/04* (2006.01)

(52) U.S. Cl. ..... 89/36.02; 89/917

(58) Field of Classification Search ..... 89/36.02, 89/906, 908, 909, 914, 917
See application file for complete search history.

(56) References Cited

U.S. PATENT DOCUMENTS

| | | | | |
|---|---|---|---|---|
| 2,279,110 | A | 4/1942 | Collins | |
| 2,321,039 | A * | 6/1943 | Nelson | 114/13 |
| 2,382,862 | A | 8/1945 | Davis, Jr. | |
| 2,697,054 | A | 12/1954 | Dietz et al. | |
| 3,205,574 | A | 9/1965 | Brennecke | |
| 3,360,848 | A | 1/1968 | Saia | |
| 3,377,693 | A | 4/1968 | Fukumoto | |
| 3,377,694 | A | 4/1968 | Simons et al. | |
| 3,395,067 | A | 7/1968 | Lane, Jr. | |
| 3,509,833 | A | 5/1970 | Cook | |
| 3,516,898 | A | 6/1970 | Cook | |
| 3,614,827 | A | 10/1971 | Knop et al. | |
| 3,649,227 | A | 3/1972 | Fetzer et al. | |
| 3,671,374 | A | 6/1972 | Kolarik | |
| 3,672,033 | A | 6/1972 | Richter | |
| 3,700,534 | A | 10/1972 | Cook | |
| 3,730,415 | A | 5/1973 | Richter | |
| 3,761,007 | A | 9/1973 | Richter | |
| 3,875,326 | A | 4/1975 | Hofer | |
| 3,962,976 | A | 6/1976 | Kelsey | |
| 4,146,164 | A | 3/1979 | Anderson et al. | |
| 4,280,393 | A | 7/1981 | Giraud et al. | |
| 4,312,903 | A | 1/1982 | Molari, Jr. | |
| 4,362,083 | A | 12/1982 | Straub | |
| 4,426,429 | A | 1/1984 | Di Russo et al. | |
| 4,496,096 | A | 1/1985 | Persson | |

(Continued)

FOREIGN PATENT DOCUMENTS

RU 2 175 430 C2 10/2001

(Continued)

OTHER PUBLICATIONS

Alcan 5083/5086, Marine Aluminum Alloys, 2003 (2 pages).

(Continued)

*Primary Examiner* — Stephen M Johnson
(74) *Attorney, Agent, or Firm* — Finnegan, Henderson, Farabow, Garrett & Dunner, LLP

(57) ABSTRACT

An armor system for defeating a solid projectile having a first armor plate, an interior armor plate, and an inner armor plate displaced from one another to form a first dispersion space between the first armor plate and the interior armor plate. The first dispersion space is sufficiently thick to allow significant lateral dispersion of armor passing therethrough. The inner armor plate is disposed approximately parallel to the interior armor plate and displaced therefrom to form a second dispersion space between the interior armor plate and the inner armor plate. The second dispersion space is sufficiently thick to allow significant lateral dispersion of materials passing therethrough.

33 Claims, 13 Drawing Sheets

U.S. PATENT DOCUMENTS

| | | | | | |
|---|---|---|---|---|---|
| 4,561,585 | A | | 12/1985 | Persson | |
| 4,612,259 | A | | 9/1986 | Ueda | |
| 4,664,967 | A | | 5/1987 | Tasdemiroglu | |
| 4,738,184 | A | | 4/1988 | Böhne et al. | |
| 4,807,795 | A | | 2/1989 | LaRocca et al. | |
| 4,813,334 | A | | 3/1989 | Bloks et al. | |
| 4,833,968 | A | | 5/1989 | Böhne et al. | |
| 4,857,414 | A | | 8/1989 | Araki et al. | |
| 4,867,369 | A | | 9/1989 | Persson | |
| 4,901,905 | A | | 2/1990 | Persson | |
| 4,925,084 | A | | 5/1990 | Persson | |
| 5,045,371 | A | | 9/1991 | Calkins | |
| 5,104,027 | A | | 4/1992 | Persson | |
| 5,191,166 | A | | 3/1993 | Smirlock et al. | |
| 5,214,235 | A | | 5/1993 | Froeschner | |
| 5,272,954 | A | | 12/1993 | Crouch | |
| 5,349,893 | A | | 9/1994 | Dunn | |
| 5,402,703 | A | | 4/1995 | Drotleff | |
| 5,516,595 | A | * | 5/1996 | Newkirk et al. | 428/697 |
| 5,533,781 | A | | 7/1996 | Williams | |
| 5,620,652 | A | | 4/1997 | Tack et al. | |
| 5,723,807 | A | * | 3/1998 | Kuhn, II | 89/36.02 |
| 5,738,925 | A | * | 4/1998 | Chaput | 428/101 |
| 5,792,974 | A | | 8/1998 | Daqis et al. | |
| 5,804,757 | A | | 9/1998 | Wynne | |
| 5,849,393 | A | | 12/1998 | Slattery | |
| 5,866,839 | A | | 2/1999 | Ohayon | |
| 5,905,225 | A | * | 5/1999 | Joynt | 89/36.02 |
| 5,970,843 | A | | 10/1999 | Strasser et al. | |
| 5,976,656 | A | | 11/1999 | Giraud | |
| 6,112,635 | A | * | 9/2000 | Cohen | 89/36.02 |
| 6,135,006 | A | | 10/2000 | Strasser et al. | |
| 6,477,934 | B1 | | 11/2002 | Bruhn et al. | |
| 6,619,181 | B1 | | 9/2003 | Frey et al. | |
| 6,622,608 | B1 | | 9/2003 | Faul et al. | |
| 6,658,984 | B2 | | 12/2003 | Zonak | |
| 6,718,861 | B1 | | 4/2004 | Anderson, Jr. et al. | |
| 6,777,106 | B2 | | 8/2004 | Catteau et al. | |
| 6,792,843 | B2 | | 9/2004 | Mohr et al. | |
| 6,986,715 | B2 | | 1/2006 | Mahaffey | |
| 7,077,048 | B1 | | 7/2006 | Anderson, Jr. et al. | |
| 7,121,957 | B2 | | 10/2006 | Hocknell et al. | |
| 2002/0061417 | A1 | | 5/2002 | Shindo et al. | |
| 2003/0003281 | A1 | | 1/2003 | Catteau et al. | |
| 2003/0031889 | A1 | | 2/2003 | Shindo et al. | |
| 2003/0110932 | A1 | | 6/2003 | Mohr et al. | |
| 2003/0159575 | A1 | | 8/2003 | Reichman | |
| 2004/0137260 | A1 | | 7/2004 | Groll et al. | |
| 2004/0159545 | A1 | | 8/2004 | Michaluk | |
| 2004/0209704 | A1 | | 10/2004 | Mahaffey | |
| 2005/0252113 | A1 | | 11/2005 | Duclos et al. | |
| 2005/0257677 | A1 | | 11/2005 | Ravid et al. | |
| 2005/0274775 | A1 | | 12/2005 | Michaluk | |
| 2006/0079346 | A1 | | 4/2006 | Hocknell et al. | |
| 2006/0162537 | A1 | | 7/2006 | Anderson, Jr. et al. | |
| 2006/0162538 | A1 | | 7/2006 | Pfennig et al. | |
| 2006/0284338 | A1 | | 12/2006 | Brown et al. | |
| 2007/0068377 | A1 | | 3/2007 | Qiao et al. | |
| 2007/0089595 | A1 | | 4/2007 | Shah et al. | |
| 2007/0225086 | A1 | | 9/2007 | Lin | |

FOREIGN PATENT DOCUMENTS

| | | | |
|---|---|---|---|
| SE | 522 191 | C2 | 1/2004 |
| WO | WO 03/058149 | A2 | 7/2003 |
| WO | WO 2006/085939 | A2 | 8/2006 |
| WO | WO 2007/015231 | A1 | 2/2007 |
| WO | WO 2008/054494 | A2 | 5/2008 |

OTHER PUBLICATIONS

Alclad Aluminum 6061-T6, T651 (1 page).
Alcoa, Alloy 7075, Plate and Sheet, All Around Consistent Performance (4 pages).
Alimex Planal 5083 O/H111 Aluminum Alloy (1 page).
Aluminum 5083-H116; 5083-H321 (2 pages).
Aluminum 5086-H116; 5086-H32 (3 pages).
Aluminum 6061-T6; 6061-T651 (3 pages).
AMPTIAC Quarterly, Army Materials Research: Transforming Land Combat Through New Technologies, vol. 8, Nov. 4, 2004 (8 pages).
ASM Material Data Sheet, ASM Aerospace Specification Metals Inc., Aluminum 5083-O (2 pages).
7017 Aluminum Composition Spec (1 page).
Aluminum 7039-T64 (2 pages).
Alclad Aluminum 7075-T6; T651 (1 page).
Aluminum 7075-T6; 7075-T651, 2004 (1 page).
ASM Material Data Sheet, ASM Aerospace Specification Metals, Inc., Aluminum 7178-T6, 7178-T651 (2 pages).
Aluminum 7178-T6, 7178-T651 (2 pages).
ASTM Standard for Designation: A 517/A 517M-06, May 1, 2006 (4 pages).
Benck et al., BRL Memorandum Report No. 2649, "Elastic Constants of Aluminum Alloys, 2024-T3510, 5083-H131 and 7039-T64 as Measured by a Sonic Technique", Aug. 1976 (31 pages).
Feeney, J. et al., "Environmental Fatigue Crack Propagation of Aluminum Alloys at Low Stress Intensity Levels", May 1969 (1 page).
MIL-DTL-32262 (MR), Detail Specification, Jul. 31, 2007 (15 pages).
MIL-DTL-46027K (MR), Detail Specification, Sep. 4, 1998 (28 pages).
MIL-DTL-46063H, Detail Specification, Dec. 30, 1992 (24 pages).
MIL-DTL-46100E (MR), Detailed Specification, Jul. 9, 2008 (29 pages).
ARMOX 500T, Datasheet, Armore ® Protection Plate, Oct. 1, 2007 (2 page).
Nordmark, G.E., abstract Stress-Corrosion and Corrosion-Fatigue Susceptibility of High-Strength Aluminum Alloys 2004, Scientific-Commons (1 page).
WELDOX 700, Datasheet, SAAB Oxelösund AB, Feb. 18, 2008 (2 pages).
Evans, S. W., et al. "Low-Carbon Steel as an Alternative to Conventional Roller-Quenched, Tempered Steel", Journal of the South African Institute of Mining and Metallurgy, vol. 89, No. 10. 1989, pp. 301-306 (6 pages).
http://www.iso-group.com/NSND Detail.
http://www.outokumpu.com/.
The Application of New Technology to Aluminum Armor Systems 2006 (3 pages).
ASM Metals Reference Book, Second Edition, 1983, pp. 27, 212-216, and 308 (10 pages).
Official Action from the International Searching mailed Nov. 19, 2008 (10 pages).

* cited by examiner

APPARATUS FOR DEFEATING HIGH ENERGY PROJECTILES

FIELD OF THE INVENTION

The present invention relates to an armor construction that resists penetration by high energy solid projectiles designed to defeat vehicle armor.

BACKGROUND OF THE INVENTION

Conventional armor is subjected to a variety of projectiles designed to defeat the armor by either penetrating the armor with a solid or molten object or by inducing shock waves in the armor that are reflected in a manner to cause spalling of the armor such that an opening is formed and the penetrator (usually stuck to a portion of the armor) passes through, or an inner layer of the armor spalls and is projected at high velocity without physical penetration of the armor.

Some anti-armor weapons are propelled to the outer surface of the armor where a shaped charge is exploded to form a generally linear "jet" of metal that will penetrate solid armor; these are often called Hollow Charge (HC) weapons. A second type of anti-armor weapon uses a linear, heavy metal penetrator projected at high velocity to penetrate the armor. This type of weapon is referred to as EFP (explosive formed projectile) or SFF (self forming fragment) or a "pie charge" or sometimes a "plate charge."

In some of these weapons the warhead behaves as a hybrid of the HC and the EFP and produces a series of metal penetrators projected in line towards the target. Such a weapon will be referred to herein as a Hybrid warhead. Hybrid warheads behave according to how much "jetting" or HC effect it has and up to how much of a single big penetrator-like an EFP it produces.

Various protection systems are effective at defeating HC jets. Amongst different systems the best known are reactive armors that use explosives in the protection layers that detonate on being hit to break up most of the HC jet before it penetrates the target. The problem is that these explosive systems are poor at defeating EFP or Hybrid systems Another system has been proposed to defeat such weapons where the armor is comprised of two layers with an electrical conductor disposed therebetween. An significant electric potential is created between the electrical conductor and the adjacent surfaces of the armor. When a liquid or solid penetrator penetrates the armor it creates an electrically conductive path between the armor layers and the electrical conductor through which the electrical potential is discharged. When there is sufficient electrical energy discharged through the penetrator it is melted or vaporized and its ability to penetrate the next layer of armor is significantly reduced.

Another type of anti-armor weapon propels a relatively large, heavy, generally ball-shaped solid projectile (or a series of multiple projectiles) at high velocity. When the ball-shaped metal projectile(s) hits the armor the impact induces shock waves that reflect in a manner such that a plug-like portion of the armor is sheared from the surrounding material and is projected along the path of the metal projectile(s), with the metal projectile(s) attached thereto. Such an occurrence can, obviously, have very significant detrimental effects on the systems and personnel within a vehicle having its armor defeated in such a manner.

While the HC type weapons involve design features and materials that dictate they be manufactured by an entity having technical expertise, the later type of weapons (EFP and Hybrid) can be constructed from materials readily available in a combat area. For that reason, and the fact such weapons are effective, has proved troublesome to vehicles using conventional armor.

The penetration performance for the three mentioned types of warheads is normally described as the ability to penetrate a solid amount of RHA (Rolled Homogeneous Armor) steel armor. Performances typical for the weapon types are: HC warheads may penetrate 1 to 3 ft thickness of RHA, EFP warheads may penetrate 1 to 6 inches of RHA, and Hybrids warheads may penetrate 2 to 12 Inches thick RHA. These estimates are based on the warheads weighing less than 15 lbs and fired at their best respective optimum stand off distances. The diameter of the holes made through the first inch of RHA would be; HC up to an inch diameter hole, EFP up to a 9 inch diameter hole, and Hybrids somewhere in between. The best respective optimum stand off distances for the different charges are: standoff distances for an HC charge is good under 3 feet but at 10 ft or more it is very poor; for an EFP charge a stand off distance up to 30 feet produces almost the same (good) penetration and will only fall off significantly at very large distances like 50 yards; and for Hybrid charges penetration is good at standoff distances up to 10 ft but after 20 feet penetration starts falling off significantly. The way these charges are used are determined by these stand off distances and the manner in which their effectiveness is optimized (e.g. the angles of the trajectory of the penetrator to the armor). These factors effect the design of the protection armor.

The present invention is effective against Hybrid charges because it must be placed close to the edge of the road to provide deep penetration and thus it must be angled upward to hit the desired portion of the target. As a result it does not hit the armor at a right angle to its surface. The jet is therefore at least partially deflected from its trajectory and its penetration is reduced. An effective EFP can hit from a relatively long stand off distance and has a good chance of hitting square on with good penetration but the present invention is very effective against EFPs. The Hybrid and EFP are the threats the invention is intended to address.

While any anti-armor projectile can be defeated by armor of sufficient strength and thickness, extra armor thickness is heavy and expensive, adds weight to any armored vehicle using it which, in turn places greater strain on the vehicle engine, and drive train.

Armor solutions that offer a weight advantage against these types of weapons can be measured in how much weight of RHA it saves when compared with the RHA needed to stop a particular weapon penetrating. This advantage can be calculated as a protection ratio, the ratio being equal to the weight of RHA required to stop the weapon penetrating, divided by the weight of the proposed armor system that will stop the same weapon. Such weights are calculated per unit frontal area presented in the direction of the anticipated trajectory of the weapon.

Thus, there exists a need for an armor that can defeat the projectiles from anti-armor devices without requiring excess thicknesses of armor. Preferably, such armor would be made of material that can be readily fabricated and incorporated into a vehicle design at a reasonable cost, and even more preferably, can be added to existing vehicles.

As the threats against armored vehicles increase and become more diverse, combinations of armor or armor systems are needed to defeat the various threats. The present invention is in addition to the common design features needed to protect the vehicle against military assault rifle bullets, bomb shrapnel and landmine explosions. An armor system that raises the protection level of an armored vehicle to include EFP and Hybrid charges is described.

SUMMARY OF THE INVENTION

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises an armor system for defeating a solid projectile. The system includes an outer armor plate, an interior armor plate that is displaced therefrom to form a first dispersion space between the outer armor plate and the interior armor plate. The first dispersion space is sufficiently thick to allow significant lateral dispersion of material passing though the first dispersion space. The invention further includes an inner armor plate displaced from the interior armor plate to form a second dispersion space between the interior armor plate and the inner armor plate. The second dispersion space is sufficiently thick to allow significant lateral dispersion of materials passing therethrough.

An embodiment of the invention is an armor system for defeating a solid projectile having an outer armor plate comprised of an alloy of aluminum with an ultimate tensile strength greater than 20,000 lbs./in.$^2$ and a thickness in the range of from 8 to 40 millimeters. There is also an interior armor plate comprised of an alloy of aluminum having an ultimate tensile strength greater than 20,000 lbs./in.$^2$ and a thickness in the range of from 8 to 40 millimeters. The interior armor plate is disposed approximately parallel to the outer armor plate and is displaced therefrom to form a first dispersion space between the outer armor plate and the interior armor plate a distance of from 25 to 150 millimeters. The system further includes an inner armor plate comprised of an alloy of aluminum having a tensile strength greater than 20 000 lbs./in.$^2$, an elongation to break greater than 10% and a thickness in the range of from 8 to 40 millimeters. The inner aluminum armor plate is disposed approximately parallel to the interior armor plate and is displaced therefrom to form a second dispersion space between the interior armor plate and the inner aluminum armor plate at a distance of from 25 to 150 millimeters. The system then also includes a steel armor plate having a Brinell hardness greater than 350 and a thickness in the range of from 4 to 20 millimeters. The steel armor plate is displaced from the inner aluminum interior armor plate to form a third second dispersion space of from 5 to 30 millimeters. This embodiment may preferably be used to improve the protection of a vehicle where the body of the vehicle includes a layer of sheet armor affixed to its interior surface, as for example a rigid polymer/fiber composite and/or a layer of penetration resistant fabric.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE PREFERRED EMBODIMENTS

Figure 1:
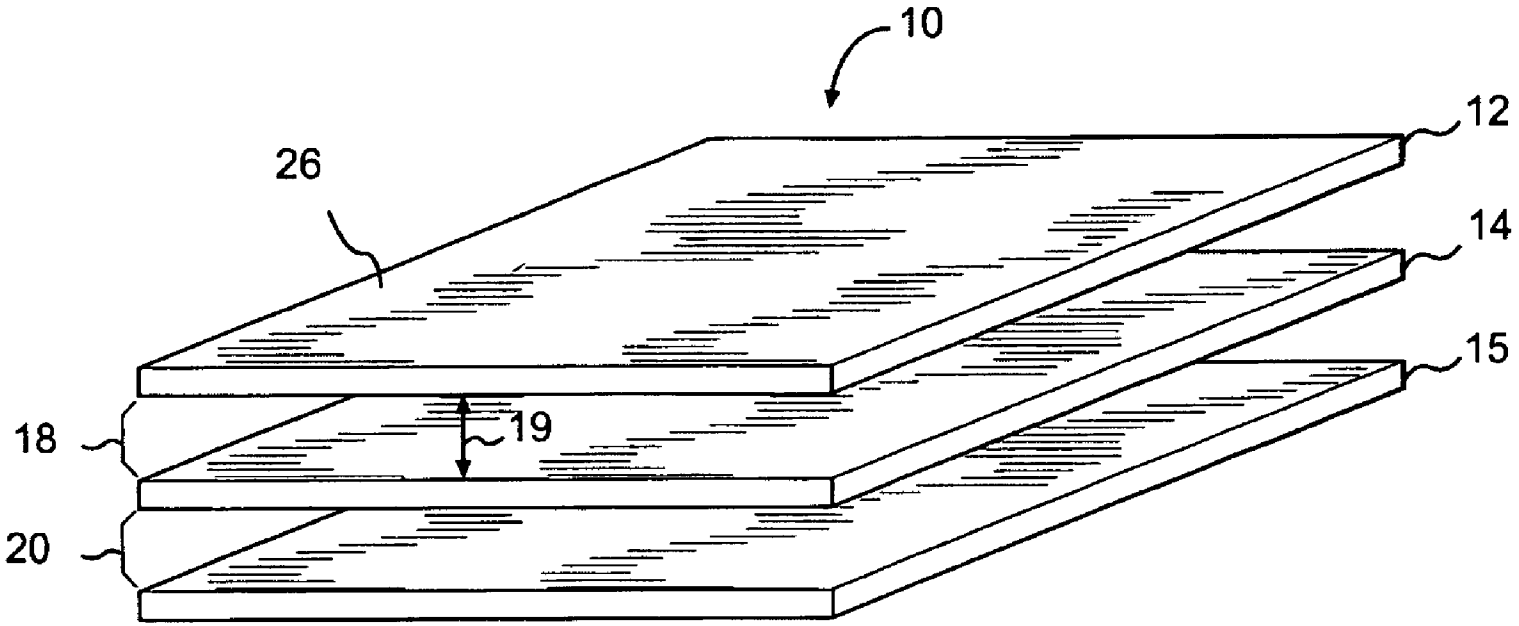
FIG. 1 is a perspective view of one embodiment of the present invention where the armor plates providing the additional protection against EFP or Hybrid charges have planar surfaces.

Reference will now be made in detail to the present preferred embodiments of the invention, examples of which are illustrated in the accompanying drawings. Wherever possible, the same reference numbers will be used throughout the drawings to refer to the same or like parts.

In accordance with the invention, there is provided an armor system for defeating a solid projectile. While the invention and its embodiments may impede penetration of elongated metal "jets" produced by shape charges, its primary utility is to defeat relatively, non-elongated, heavy, solid metal projectiles formed and propelled by either manufactured explosive devices or improvised explosive devices. Embodiments of the invention may include systems for addressing metal jets and/or elongated heavy metal penetrators in addition to the portion of the system that deals with non-elongated solid metal projectiles. The parameters of the system can be selected to defeat a particular projectile if its weight, density, velocity, and size are known. The parameters of the system are the mechanical properties (ultimate tensile strength, hardness, elastic modulus, fracture toughness, and velocity of forced shock) of the layers of material comprising the layers of the invention, the spacing of the layers (the distance between layers, i.e. the thickness of the dispersion space) and the nature of any materials placed in the space between the layers.

In accordance with the invention there is provided an outer plate. The plate may have parallel, opposing flat surfaces, or in certain embodiments the surface of the plate on which a projectile would first impinge (the "outer" surface) may include a plurality of projections on the outer surface. The projections are disposed to at least partially fragment solid projectiles impinging on the outer surface of the plate. The size and configuration of the projections are determined by the properties of the projectile and the material forming the plate. It is not the purpose of the projections on the outer surface of the first plate to defeat the projectile but to induce at least some fragmentation or deform the projectile in a manner that its passage through the first layer will fragment the projectile or deflect the projectile from its initial direction of flight. As will be disclosed further, the primary goal of the invention is to induce dispersion of the projectile as it passes through the initial layers of the system. What is meant by dispersion is the deflection of portions of the projectile and any portions of the material forming layers in the system from the initial trajectory of the projectile.

Another embodiment of the invention has a plurality of projections on the inner surface of a plate. The purpose of the plurality of projections on the inner surface is to disperse solid projectiles erupting through the inner surface of the plate. The mechanism by which the inner surface induces dispersion of materials may not be the same as that of projections on a surface on which the projectile impinges but, irrespective of the mechanism, the projections on the inner surface disperse the material erupting therefrom and in doing so achieves one of the objectives of the system. The shockwaves passing through the system provide the energy for the eruption at the inner surface of the plate but the direction of the eruption is dictated by the shape of the inner surface of the material with the shockwave energy in it and the material adjacent the inner surface into which the shock energy is to be transmitted. When the material receiving the shock energy from the solid has a significantly lower velocity of transmission of a forced shock wave the energy will be reflected at the surface and not transmitted. For example, where the material with the shock wave in it is a solid (e.g. aluminum or steel that conduct shockwaves at 5000 meters/sec.) and the material receiving the shock wave is air (having a velocity of transmission of a forced shock wave of only 330 meters/sec.) the mismatch will cause the energy to build up at the plate surface involved and then cause an eruption. One form of such an eruption is known as spalling The material properties of the solid material forming the plates effect the dissipation of energy and transmission of momentum away from the penetration line and thereby effect how spalling occurs at the rear of the metal plates. If the material is brittle (like with most ceramics) the hardness advantage at the front face is lost at the rear face where the spalling occurs because the material has a very low elongation to break and the material breaks into small pieces carrying less energy off the line of penetration. A large single spall can develop in materials like steels and other metals when they exhibit a value for elongation to break of 10% or more. A material with a high tensile strength (like more than 30,000 lbs./in.$^2$ for aluminum) coupled to a high elongation value requires a larger amount of energy to tear loose a large spall. A heavy spall relative to the mass of the striking projectile will, through the laws of conservation of momentum, result in a larger drop in velocity of the components exiting rear of the plate and being carried across the dispersion space onto the next protection plate.

As will be disclosed in more detail below, the system is comprised of a plurality of layered plates separated by what is termed a dispersion space. In some embodiments projections from the outer or inner surface used to induce dispersion of the material impinging on or erupting from a surface can be used on any one of the plates in the system on both opposing surfaces, the outermost surface, the innermost surface, or not at all.

In another embodiment, where the trajectory of the projectile (and hence its expected line of penetration) is known, the armor plate may be angled so that the line of penetration is no longer perpendicular to the outer surface. In such an embodiment at least one of the armor plates are inclined with respect to the anticipated trajectory of the projectile. It is preferred that each of the plates be inclined at an angle of 20° or more with respect to the anticipated trajectory of the projectile.

In accordance with the invention, the system includes an interior plate disposed approximately parallel to the outer armor plate and displaced therefrom to form a first dispersion space between the outer armor plate and the interior armor plate.

As here embodied, and depicted schematically in FIG. 1, there is a series of generally parallel plates 10, comprised of an outer armor plate 12, an interior armor plate 14, and an inner armor plate 15. As used herein "armor plate" is a plate-like member disposed to fragment, deflect, or disperse a projectile or absorb energy from the projectile to facilitate its defeat by other portions of the system. It may be a know armor plate material (i.e. a metal plate of high strength) or a conventional metal plate of lower strength than conventional armor plate that is used in the present invention to affect a projectile such that other elements in the armor system defeat the projectile. In a preferred embodiment the inner armor plate 15 may comprise the armor plate 16 of the body of an armored vehicle (See FIG. 9) or a third lower density armor 15 that is then in turn followed by the armor plate 16 of the vehicle body. The later embodiment will be further disclosed in detail below. As here embodied and depicted in FIG. 1, the system includes a first dispersion space 18, separating plates 12 and 14 a distance 19, a second dispersion space 20, with the outer surface of the series of plates 10 being surface 26 of plate 12.

In accordance with the invention, the series of plates are separated by a dispersion space. As noted above, a dispersion space is the space between adjacent plates and it is the function of the dispersion space to allow lateral dispersion of material passing therethrough. The term lateral means in a direction at an angle from the initial line of flight of the projectile, i.e. its trajectory. The more the moving material is dispersed the less concentrated is the energy impinged on the next successive layer. In addition, the greater the distance between layers (the greater the thickness of the dispersion space) the less kinetic energy per surface area will be possessed by the moving material. Clearly if the dispersion distance is very large, large amounts of kinetic energy will be spread out from the original penetration line and lost, but the resulting layered structure will be impractically thick. On the other hand, if the thickness of the dispersion space is too small the moving material is not dispersed, its kinetic energy and momentum is not dissipated, and it may have sufficient energy and concentration to defeat subsequent layers of the system. One skilled in the art to which the invention pertains, with the general guidance provided herein, in combination with the example below can devise a system to defeat a particular projectile or mix of projectiles traveling at a particular velocity along a particular trajectory.

In a preferred embodiment of the invention the first armor layer is a relatively tough, ductile material. It may have a relatively thin, hard material on its outer surface, e.g. a layer of ceramic material, to induce fracture and or deformation of the projectile, but in this embodiment the function of the first armor layer is to absorb some of the energy of the projectile, to flatten it (laterally displace at least some of its mass) and to significantly reduce its velocity.

Figure 2A:
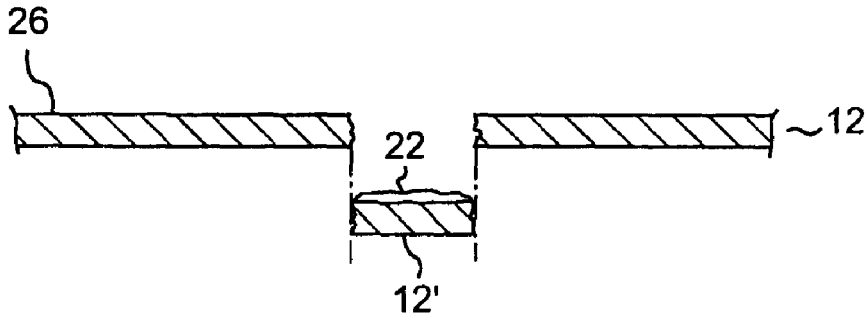
FIGS. 2A-B are schematic, cross-sectional views of two different armor plates being challenged by a relatively heavy, non-elongated solid projectile.

As depicted in FIG. 2A a relatively heavy projectile 22 that encounters a plate of high strength but low toughness (e.g. a metal that has a deformation of less than 5% at tensile rupture) deforms on its surface and the shock of the impact of the projectile shears a portion of the plate 12' from the plate 12 and the combination of the deformed projectile 22 and the portion 12' of the plate pass through the plate 12. Because the plate 12 is hard and strong there is no significant deformation of the plate, or absorption of energy or reduction of velocity of the projectile. Alternatively if the projectile has a velocity great enough that the velocity of the shockwaves in the plate cannot precede the penetrating projectile then the metal of the armor is displaced radially into the armor itself. Then the penetrating projectile does not break loose sufficient of the armor plate in front of it to affect momentum loss to the projectile and so reduce the maximum amount of velocity reduction for that penetration. The radial displacement mechanism is the method that HC jets use to penetrate armor. This allows an HC charge to defeat greater thicknesses of armor than an EFP.

Figure 2B:
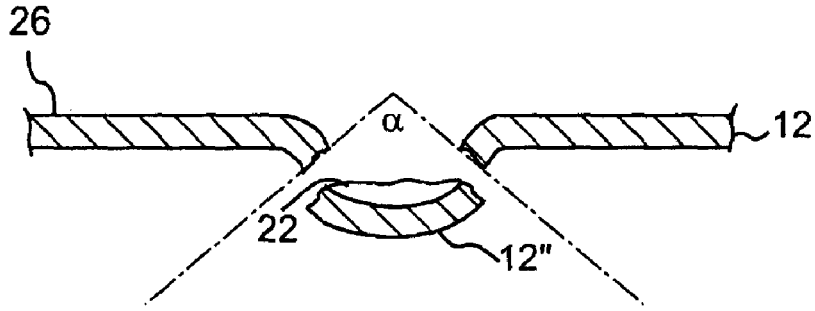

As depicted in FIG. 2B a relatively heavy projectile 22 that encounters a plate of lower strength but higher toughness (e.g. a metal that has a deformation of greater than 7% at tensile rupture, and preferably greater than 10%) deforms on its surface and the plate 12 deforms in response, absorbing energy. After deforming the plate the projectile shears a portion of the plate 12" from the plate 12 and the combination of the deformed projectile 22 and the portion 12" of the plate pass through the plate 12. There is, however, significant deformation of the plate, absorption of energy caused by the shearing of a large area of the plate 22 and because of the combined mass of the portion of the plate 12" and the projectile 22, there is a significant reduction of velocity of the that combination.

The velocity of shockwaves in the armor plate should be significantly faster than the velocity of the penetrator. The toughness of the armor plate can then be brought to bear and the tear line can, by reflection and resonance, give a favorable tear line depicted in FIG. 2B as angle $\alpha$. The larger the angle $\alpha$, the more energy is absorbed in the deformation of the plate being penetrated, and the larger the combined weight of the penetrator and the portion of the armor adherent to it.

The velocity of forced shockwaves in steels and aluminum alloy plates is about 5,000 meters/sec., so if the striking projectile has a velocity close to or higher than that the penetration would behave more like an HC. The penetration of an HC depends on the density of the material it is penetrating and lower density materials perform better. When dealing with high velocity strikes aluminum armor is preferable to steel armor but when the velocity has been reduced by preceding penetrations then tough steel plates also become effective. EFP normally have a velocity of 2,500 meters/sec. or slower and Hybrids have the smaller and lighter leading penetrators moving at 3,000 to 3,500 meters/sec. so they are more difficult to stop. For an EFP the energy absorbed by the plate 12 is directly proportional to the deformation of the plate and the angle $\alpha$ depicted in FIG. 2B.

The relationship of the mass and velocity of the projectile conforms to a conservation of momentum relationship of: $M_p \cdot V_p = (M_p + M_s) \cdot (V_{p\&s})$, where $M_p$ is the mass of the projectile, $V_p$ is the velocity of the projectile at impact, $M_s$ is the mass of the sheared portion of the plate (12' in FIG. 2A, 12" in FIG. 2B), and $V_{p\&s}$ is the velocity of the combined projectile and sheared portion of the plate.

In accordance with the invention, the first dispersion space is sufficiently thick to allow significant lateral dispersion of material passing though the first dispersion space. As here embodied in a system comprised of a series of armor plates shown in FIG. 1, the first dispersion space 18 has a sufficient thickness (as indicated by arrow 19) to allow significant lateral dispersion of material (the projectile and portions of the plate 12, shown schematically in FIGS. 3A-D) within the dispersion space 18.

Figure 3A:
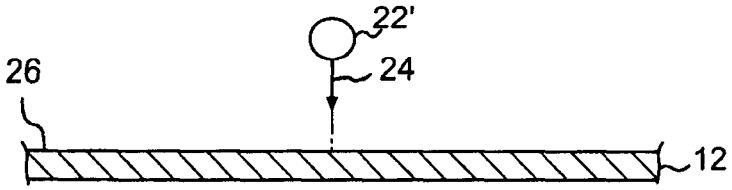
FIGS. 3A-D depict a sequence of schematic cross-sectional side views of an armor plate being penetrated by a single relatively heavy, non-elongated solid projectile.

As shown schematically in FIG. 3A, the single projectile 22 is traveling toward outer plate 12 along its initial trajectory indicated by arrow 24. While the projectile is depicted as generally spherical, it can be of any particular shape but the invention is particularly useful for non-elongated projectiles because they are easier to deform into flatter shapes that can be more readily induced to deviate from their initial trajectory.

Figure 3B:
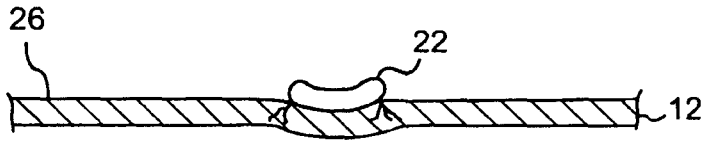
Figure 3C:
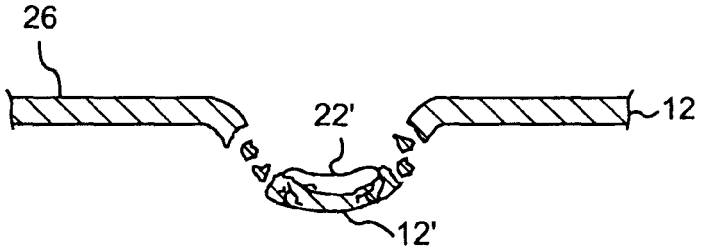
Figure 3D:
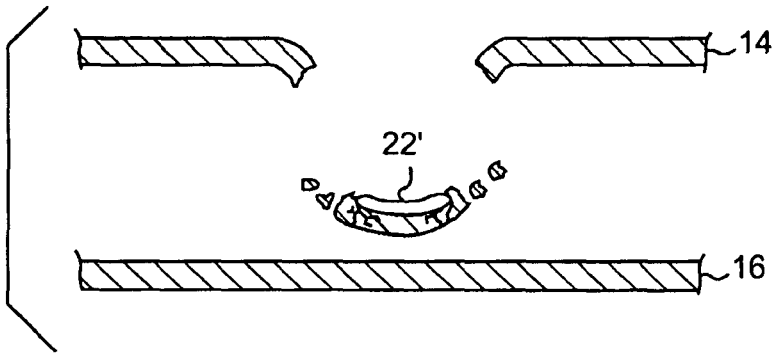

As shown schematically in FIG. 3B, the projectile 22 has encountered the outer armor layer 12. The projectile has deformed laterally to a flatter shape and deformed the plate. As disclosed above, the exact configuration of the cracks induced by the shock varies in response to the toughness of the material from which the plate 12 is formed, but as the projectile encounters a metal layer, it tends to eject an almost unitary plug comprised of the material of armor plate 12' with the deformed projectile 22 imbedded thereon as is depicted schematically in FIG. 3C. FIG. 3D depicts the effect of lateral deformation of the combined projectile and armor plug. It is no longer flat and may be in a number of separate pieces. In such a configuration its impact and effect on the next armor plate it encounters will be substantially different than that of just the projectile on the first armor layer. Even if the combined projectile and armor plug are still unitary, it has been significantly slowed, has a larger frontal surface and is no longer flat.

Figure 4A:
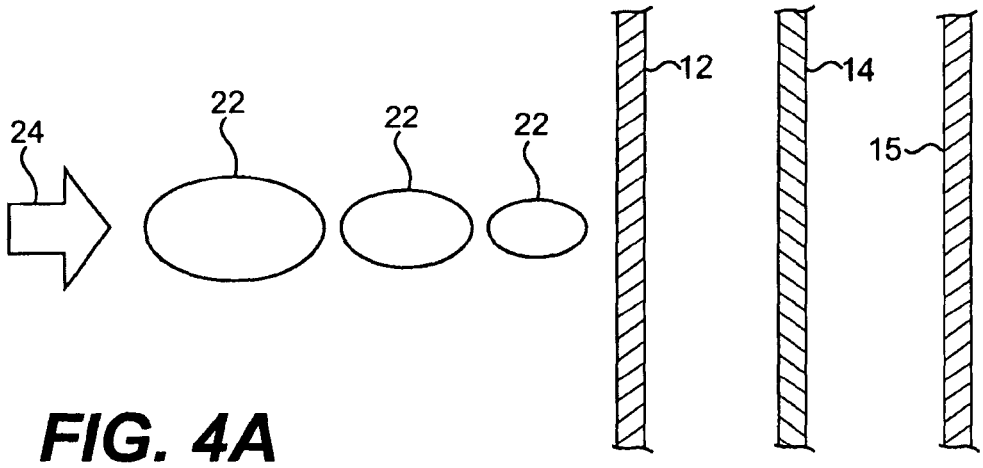
FIGS. 4A-F depict a sequence of schematic cross-sectional side views of armor plates being penetrated by a series of relatively heavy, non-elongated solid projectiles.
Figure 4B:
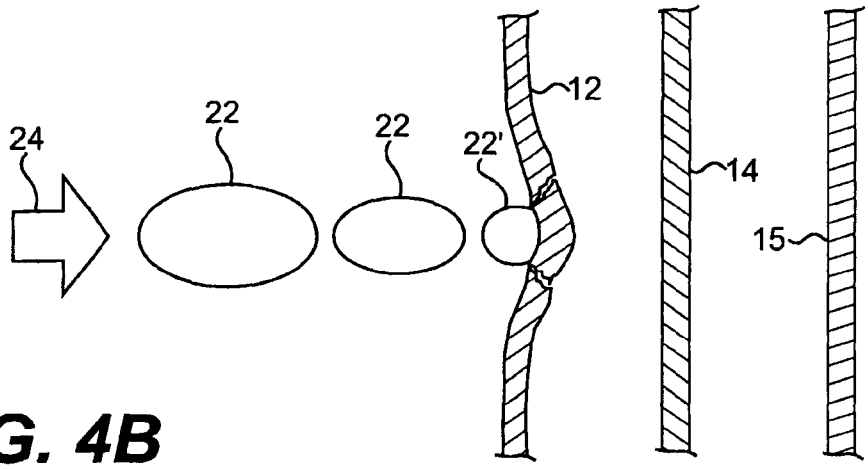
Figure 4C:
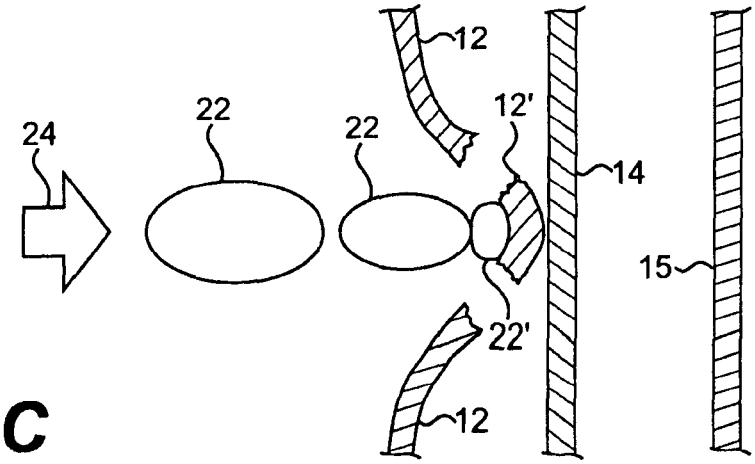
Figure 4D:
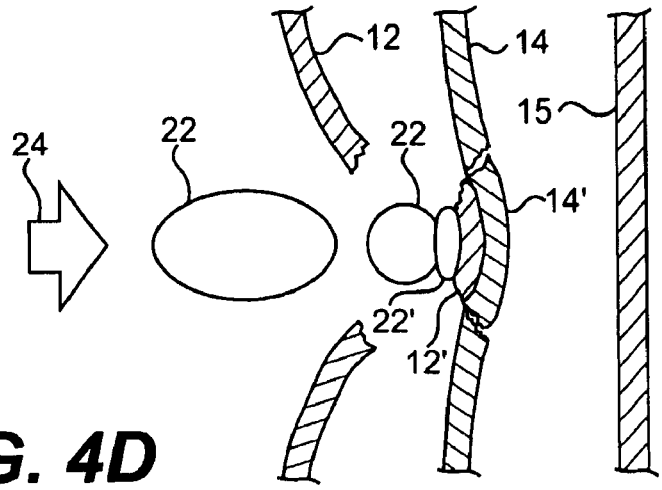
Figure 4E:
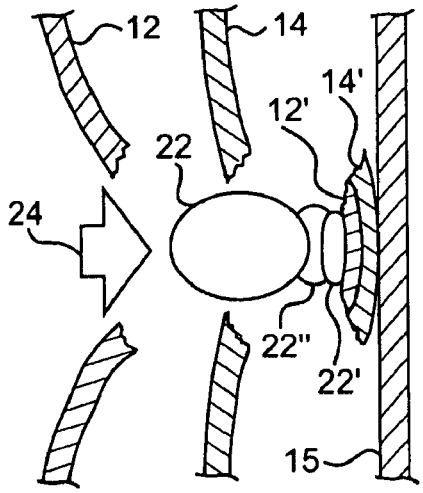
Figure 4F:
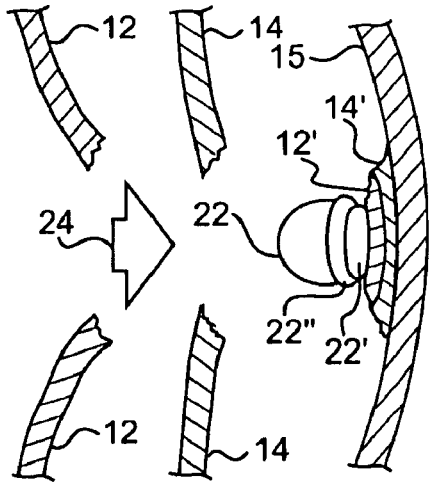

As shown schematically in FIG. 4A-F multiple projectiles 22 are traveling toward outer plate 12 along the initial trajectory indicated by arrow 24. While the projectiles are depicted as generally spherical, they can be of any particular shape As shown schematically in FIG. 4B, the first projectile 22 has encountered the outer armor layer 12. The projectile 22' has deformed laterally to a flatter shape and deformed the plate. As disclosed above, the exact configuration of the cracks induced by the shock varies in response to the toughness of the material from which the plate 12 is formed, but as the projectile encounters a metal layer, it tends to eject an almost unitary plug comprised of the material of armor plate 12' with the deformed projectile 22' imbedded thereon as is depicted schematically in FIG. 4C. FIG. 4D depicts the effect of the combined and laterally larger projectile 22' and portion of the first layer of armor 12', as well as the second projectile on the second layer 14. Lateral deformation of the combined projectile 22' and armor plug 12' have sheared and ejected a still larger combination of the two projectiles 22' and 22" and portions 12' and 14' of the first and second armor plates. The combination of the projectiles 22' and 22" and portions of the armor plates (12' and 14') that have been sheared from the first two armor plates 12 and 14 encounter the final layer of armor in FIG. 4E. The combination deforms the final armor plate 15 in FIG. 4F but the size of the combination of projectiles and portions of armor sheared from the first layer are moving with a velocity that is insufficient to defeat the last armor layer 15.

In a preferred embodiment the outer armor layer has an ultimate tensile strength of 50,000 lbs./in.$^2$ for steel plates and 30,000 lbs./in.$^2$ for aluminum so that the high speed penetrator can be substantially flattened when hitting the surface of the armor. The armor should however not be too brittle and allow the deformation shock to crack and break a hole through the initial armor layer without removing both energy and momentum along the penetration line. Such a non-preferred occurrence is depicted in FIG. 2A. Preferably such a layer will have an elongation at tensile rupture of greater than 10%. When the outer armor layer has a high fracture toughness the mass of the material penetrating the outer layer may increase, but its velocity decreases and the material is laterally dispersed.

Where the armor plates are an aluminum alloy it is preferred that they consist essentially of an aluminum alloy having an elongation at fracture of at least 7% and more preferably 10%. Examples of preferred aluminum alloys include: 7017, 7178-T6, 7039 T-64, 7079-T6, 7075-T6 and T651, 5083-0, 5083-H113, 5050 H116, and 6061-T6. When the armor layer consists essentially of an aluminum alloy it is preferred that it have a thickness in the range of from 8 to 40 millimeters. Where the outer armor plate is steel it is preferred that such a plate consist essentially of material having an elongation at fracture of at least 7% and more preferably 10%. Examples of preferred steels include: SSAB Weldox 700, SSAB Armox 500T (products of SSAB Oxelösund of Oxelösund, Sweden), ROQ-TUF, ROQ-TUF AM700 (products of Mittal Steel, East Chicago, Ind., USA), ASTM A517, and steels that meet U.S. Military specification MIL-46100. When the armor layer consists essentially of steel it is preferred that it have a thickness in the range of from 5 to 20 millimeters.

High strength materials can be used on the outer surface of the first armor plate 12. An example of such a material would be ceramic armor. Such an outer layer can induce fragmentation of the projectile and address other types of projectiles than the relatively heavy, soft projectiles addressed by the present invention.

In another preferred embodiment the surface or surfaces of at least one of the armor plates is configured to induce fragmentation of the projectile and the material being penetrated by the projectile.

Figure 5A:
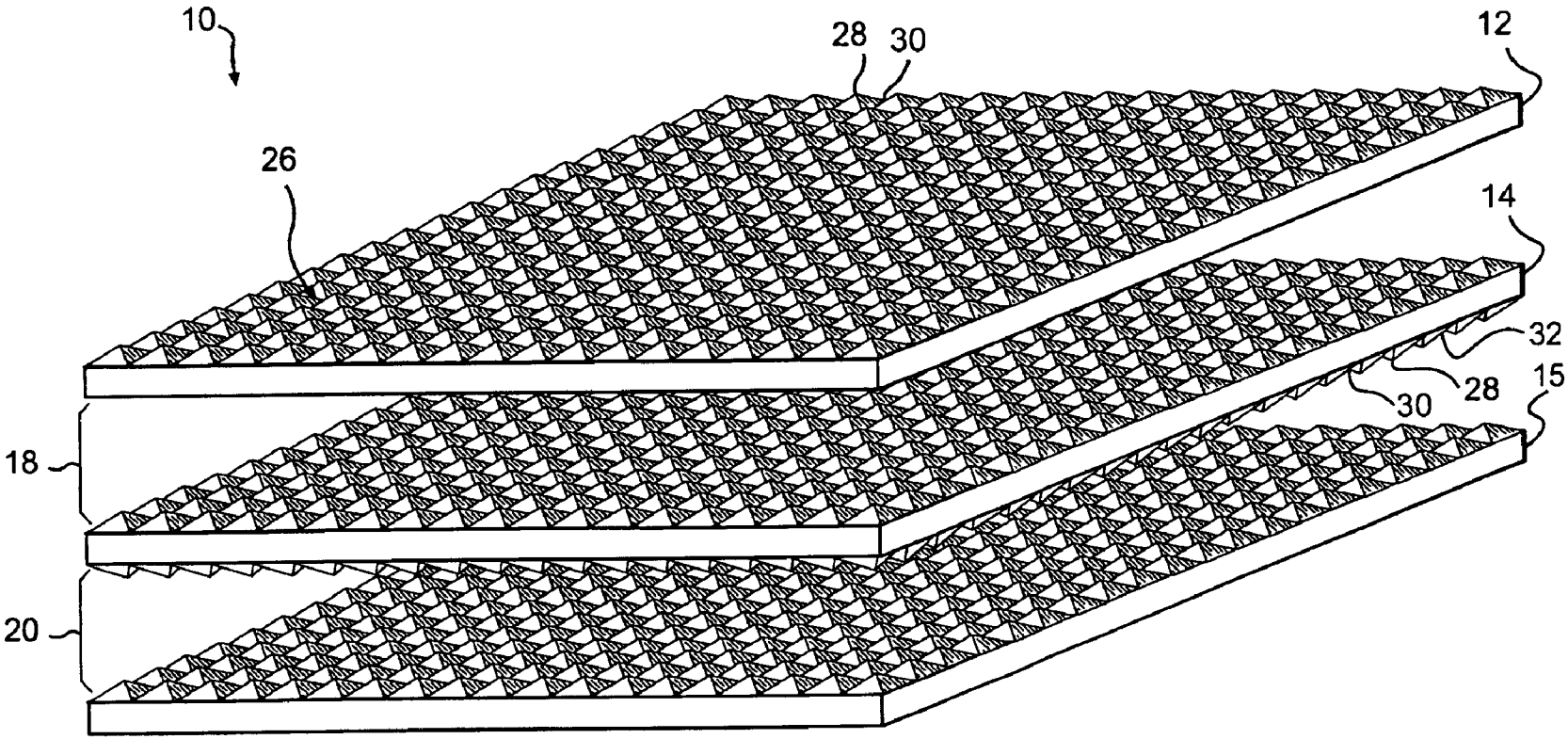
FIG. 5A is a perspective view of one embodiment of the present invention where the layered plates have a plurality of projections on the outer surfaces of the armor layers.

As here embodied, and depicted in FIGS. 5A and B, the outer surface of the armor plate 26 opposite dispersion space 18, includes a plurality of projections 28. The projections depicted in FIGS. 5A and B are pyramidal, but the configuration of the projections is not known to be critical. The projections 28 are disposed to at least partially fragment solid projectiles impinging on the outer surface of the armor plate and induce as much lateral fragmenting of the material being penetrated as can be induced without the reduced thickness caused by the grooves 30 reducing the strength of the armor plate. It is also preferred that at least armor plate have an inner surface facing a dispersion space that includes a plurality of projections. As here embodied the inner surface 32 of the armor plate 14 includes projections 28 and grooves 30. The projections 30 on this side of the armor plate, where the projectile and material fragmented from the penetrated layer are erupting, is disposed to disperse the solid material erupting through the inner surface of the armor plate by inducing lateral fracture of the penetrated layer While the outermost armor layer of this embodiment may have projections from both its outer and inner surface, as can interior armor plates, only one or both surfaces may have projections. As depicted in FIG. 5A the outer armor layer 12 has projections 30 only on its outer surface 26, the inner armor layer 14 has projections 30 on both surfaces facing the dispersion spaces, and the innermost layer 15 has projections only in the surface facing the dispersion space 20. In such an embodiment, the plurality of projections 30 on the inner surface of the interior armor plate 14 disperse solid material impinging on the outer surface of the inner armor plate 15.

Figure 5B:
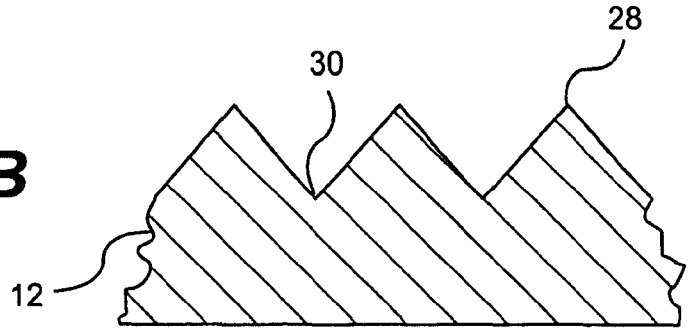
FIG. 5B is an enlarged cross-sectional view of the embodiment of FIG. 5A more clearly depicting the projections on the surface of one of a series of armor plates.

FIG. 5B more clearly depicts the configuration of the projections 28 and the grooves 30 of the embodiment depicted in FIG. 5A.

Figure 6A:
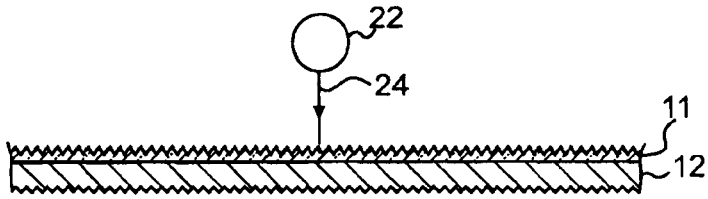
FIGS. 6A-D depict a sequence of schematic cross-sectional side views of an armor plate, textured on its outer surface, being penetrated by a single relatively heavy, non-elongated solid projectile.
Figure 6B:
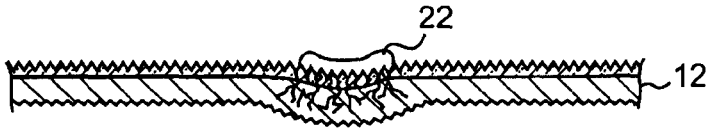
Figure 6C:
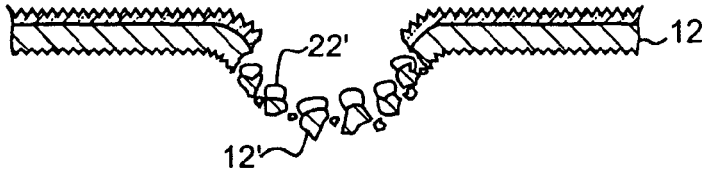

As shown schematically in FIGS. 6A-D a single projectile 22 is traveling toward outer plate 12 along its initial trajectory indicated by arrow 24. The outer armor layer 12 includes a textured outer member 11. As shown schematically in FIG. 6B, the projectile 22 has encountered the textured outer member and has deformed laterally to a flatter shape with its forward surface deformed to have a texture that is the mirror image of the texture on the outer member 11. In FIG. 6B the textured projectile has fractured at the roots of the grooves 30 of the textured surface, the plate 12 has been deformed and fractures have propagated from the projectile 22 into the plate 12. In FIG. 6C a fragmented plug comprised of the material of armor plate 12' with portions of the deformed projectile 22 imbedded in portions of the plate has been ejected. Because the projectile has fragmented the impact on the next adjacent plate will be a plurality of separate impacts that are dispersed over a wider area and the next plate receiving such materials will better resist penetration and if penetrated will more likely fracture in pieces.

Figure 6D:
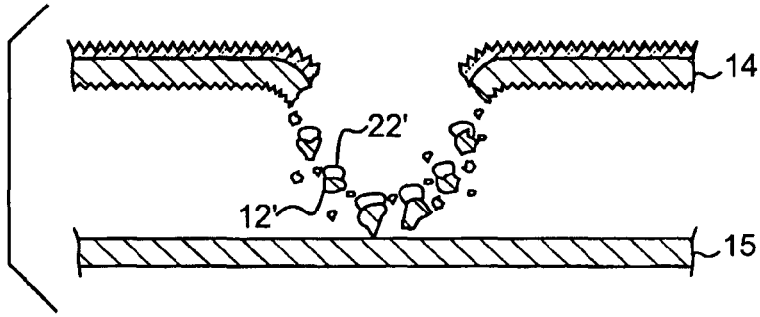

FIG. 6D depicts the effect of the impact of the fragments depicted in FIG. 6C on the next plate 14. In this embodiment the next plate 14 has texture on both the front and rear surfaces. The fragments formed of portions of the projectile 22' and portions of the outer plate 12' (actually the combination of the outer plate 12 and the textured member 11) The fragments are further deformed on the outer surface of member 14 into fragments conforming to the texture and the textured rear surface fragments into discrete fragments producing a mass of fragments that impinge on the outer surface of plate 15. In such a configuration their impact and effect on the next armor plate 15 that is encountered is substantially different than that of just the projectile on the first armor layer 12. The projectile and fragments of the previous two layers are laterally disbursed, have low individual mass, and are significantly reduced in velocity. Inner plate 15, even if it is not armor plate but of lower strength material will have a greater probability of defeating the now fragmented projectile.

Figure 7A:
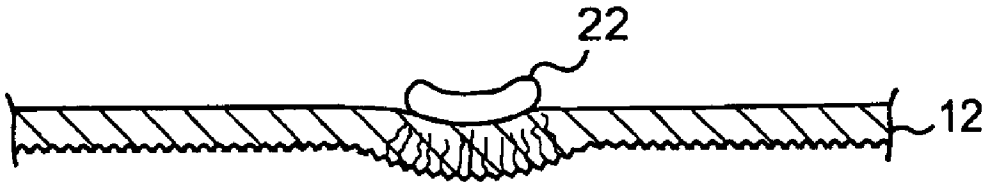
FIGS. 7A-B depict a sequence of schematic, cross-sectional side views of armor plate, textured on its inner surface, being penetrated by a single relatively heavy, non-elongated solid projectile.
Figure 7B:
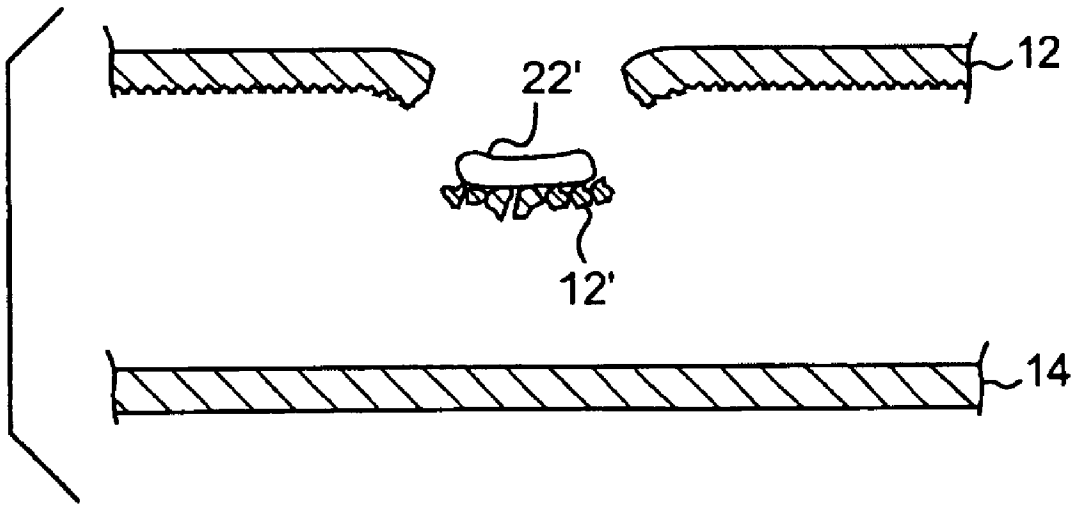

As shown schematically in FIGS. 7A-B a single projectile 22 has encountered an armor plate having texture on the side of the plate 12 opposite the side on which the projectile 22 strikes the plate 12. The projectile 22 has deformed laterally to a flatter shape and the tensile deformation of the plate 12 has induced cracks in the plate from the roots of the grooves 30 (depicted in FIG. 5B). In FIG. 7B the projectile 22' has ejected a plug comprised of fragments of the material of armor plate 12' with the deformed projectile 22' imbedded on the portions of the plate. Because the plate has fragmented, the impact on the plate 14 is a plurality of separate impacts. In such a configuration its impact, and effect on the next armor plate it encounters, will be substantially different than that of just the projectile on the first armor layer.

Another embodiment of the invention also induces lateral dispersion of material passing through the dispersion spaces in the layered device by placing dispersion elements in the dispersion space. At very high velocity impact conditions the induced forced shockwaves transmitted into the dispersion elements carry a large percentage of the energy exerted on the dispersion elements by the penetrator. The dispersion elements are then launched by this energy as a spall or the object containing the shock energy must pass the energy on to another receiver.

Figure 8:
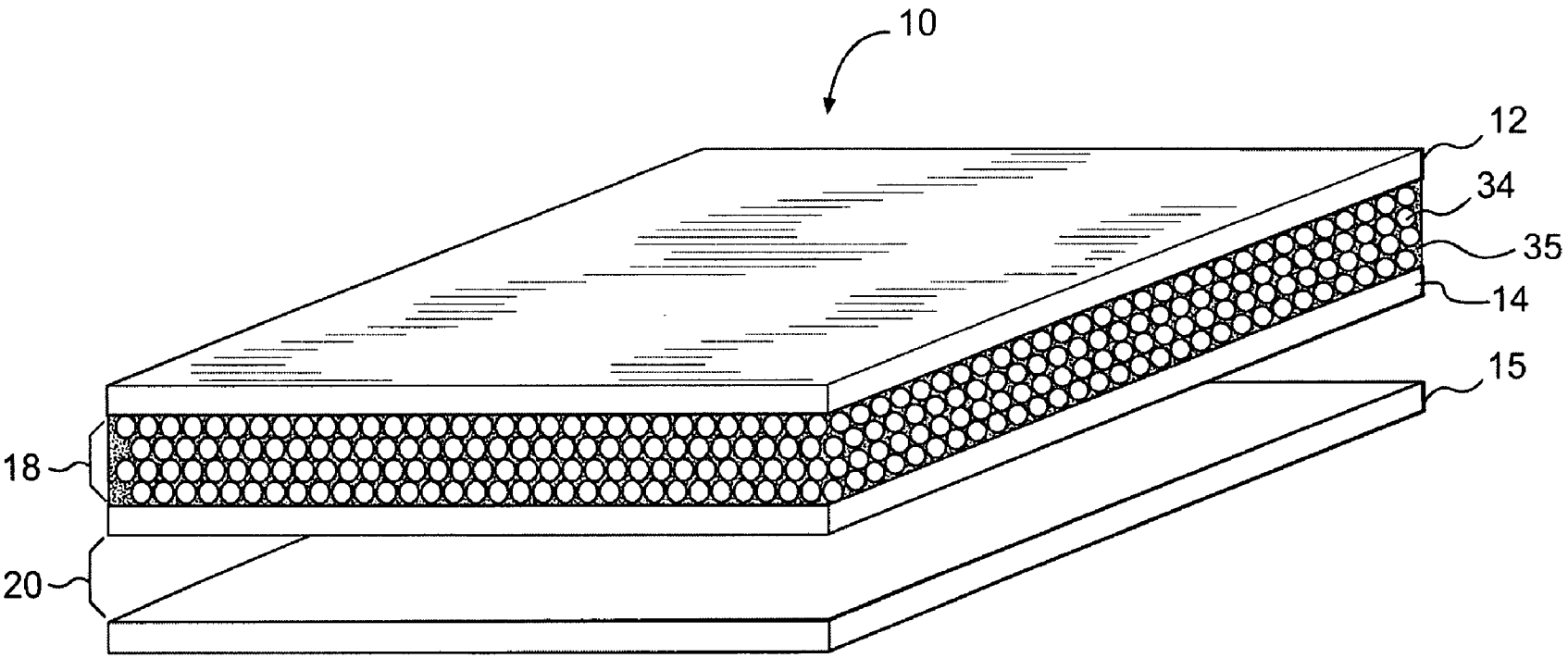
FIG. 8 is a perspective view of one embodiment of the present invention where the dispersion spaces between layered plates contain a plurality of dispersion inducing members, embodied here as glass spheres.

As here embodied and depicted in FIG. 8, the system 10 includes a plurality of spheres 34 located in the first dispersion space 18 between armor layers 12 and 14. The spheres may consist essentially of a material selected from the group consisting of brittle metal, ceramic, and glass. When the dispersion elements are surrounded by a liquid or gel that is able to conduct shock away, then the dispersion element in turn can accept more shockwave energy without shattering or being moved out of the path of the penetrator. As here embodied the system 10 includes a gel 35 surrounding the spheres 34. One embodiment may use combinations of materials with complimentary forced shockwave properties. Examples are spheres of glass or ceramics in which typically the speed of shock energy moves at more than 5,000 meters/sec. surrounded by a liquid like water (1,500 meters/sec.) or glycerin (1,800 meters/sec.) or glycol (1,800 meters/sec.) or mixtures of these liquids. The liquids can be gelled by a gelling agent like gelatin or fused silica, fused silica, potassiumpolyacrylate-polyacrylamide copolymers or similar organic polymer gel agents.

In accordance with the invention there is provided an inner armor plate disposed approximately parallel to a separate armor plate and displaced therefrom to form a second dispersion space between the separate armor plate and the inner armor plate, the second dispersion space being sufficiently thick to allow significant lateral dispersion of materials passing therethrough.

As here embodied and depicted in FIG. 1 the system includes an inner armor plate 15. As disclosed above, the primary purpose of the inner armor plate is to prevent any further penetration of material that has been dispersed and slowed by passage through the upper portions of the system, i.e., the outermost armor plate(s) and dispersion space(s). The embodiment depicted includes three plates but the inventions is not limited to that number of plates, hence reference in the disclosure to the "inner" armor plate adjacent the inner armor plate. Thus, the invention may include more than three armor plates, and it is still preferred that the inner armor plate be comprised of a material of high fracture toughness to resist any further penetration by material impinged thereon.

It is preferred that the inner plate be comprised of a material that has a Brinell hardness in excess of 350. It is further preferred that the inner plate consist essentially of a material selected from the group consisting of: an aluminum alloy, a steel alloy, and a titanium alloy, a metal matrix composite, and a polymer matrix composite. As has been repeatedly disclosed, one of the primary goals of the system is to induce dispersion of the material passing through the armor system to improve the probability that such material will not penetrate the system.

Another embodiment of the invention is the incorporation of an armor system on an existing vehicle, armored or unarmored. For an unarmored vehicle the inner armor plate should resist penetration of any material passing through the armor system so the material does not enter the vehicle. In that way the ability of an unarmored vehicle to survive attack by armor-piercing munitions or devices is significantly improved. Armored vehicles can have their resistance to attack by armor-piercing munitions or devices is further improved by the incorporation of the present invention on the exterior surface of the armored vehicle.

Figure 9:
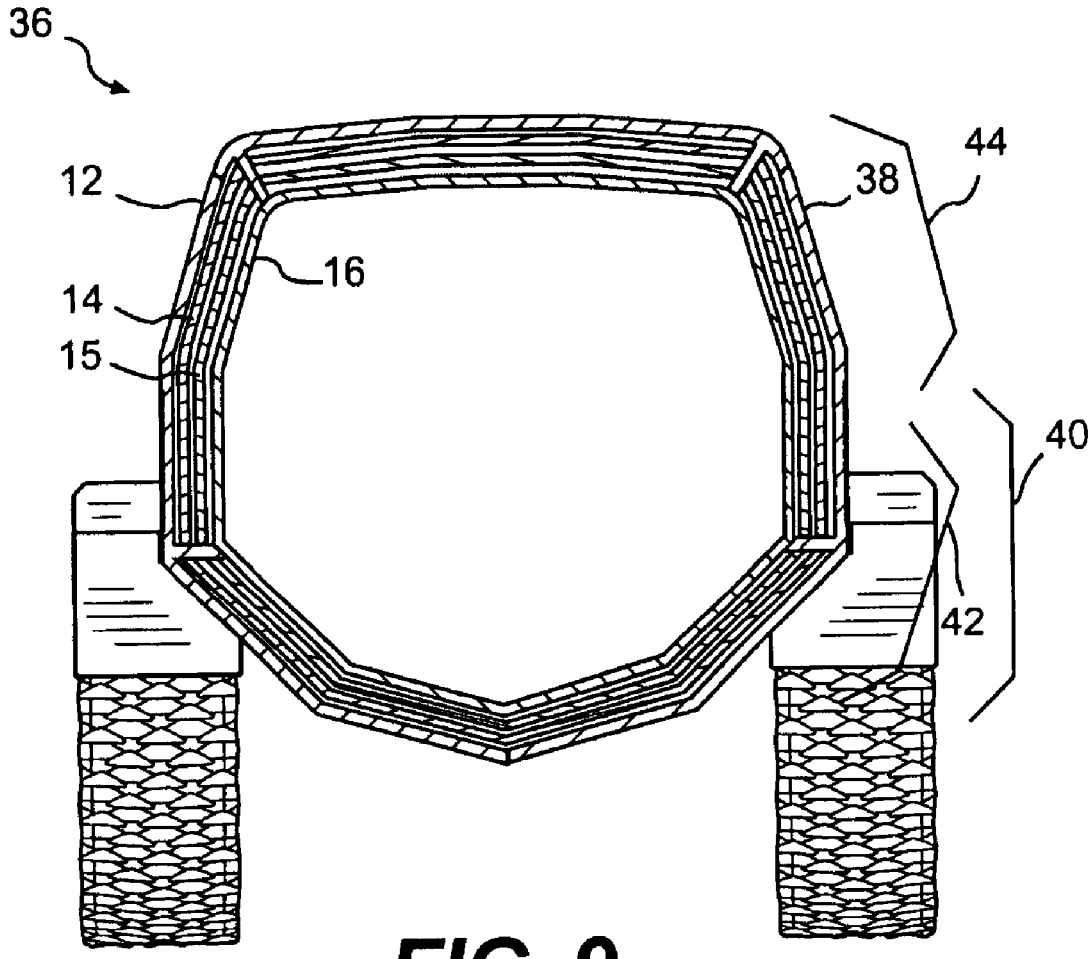
FIG. 9 is a schematic cross-sectional view of an armored vehicle including one embodiment of the present invention.

An embodiment of an armored vehicle having its penetration resistance improved is depicted in FIG. 9, a schematic cross-sectional view of a blast-resistant armored land vehicle 36 having a monocoque body 38 comprised of sheet armor. In this embodiment the body 38 has a bottom portion 40 defining at least one V, with the apex of the V substantially parallel to the centerline of the vehicle. In this embodiment the armor system of the present invention is affixed to the exterior of the armored vehicle and the inner armor layer of the armor system of the invention comprises the sheet armor body of the vehicle.

An alternative embodiment would be a separate assembly of layered armor plates added to an existing vehicle, or portions of the vehicle, to enhance its resistance to the weapons described above.

In a preferred embodiment the sheet material used to form the body 38 may be at least two different sheet materials. In the embodiment depicted the portion of the body 38 that comprises the V-shaped portion 42, here a "double-chined" V, may be formed of a tough sheet material. As used herein the word "tough" is a material that resists the propagation of a crack therethough, generally referred to as a material that has a high fracture toughness. As here embodied the bottom portion 40 (comprising the V shaped portion 42) is preferably sheet steel known as "ROQ-tuf AM700 (a product of Mittal Steel, East Chicago, Ind.). Another material known as SSAB Weldox 700 (a product of SSAB Oxelösund of Oxelösund, Sweden) is also preferred as the material for the bottom portion 40. Steels normally used for the construction of boilers like A517, A514 and other steels having similar yield strengths and elongation to break comparable to ROQ-tuf and Weldox 700 may also be used. The upper portion 44 of the body 38 is preferably formed of armor plate. A particularly preferred material is known as SSAB Armox 400 (a product of SSAB Oxelösund of Oxelösund Sweden), although an armor meeting U.S. MIL-A-46100 will be operable. Generally, the sheet material preferably consists essentially of a metal selected from the group consisting of: steel, steel armor, titanium alloys, and aluminum alloys.

Figure 10:
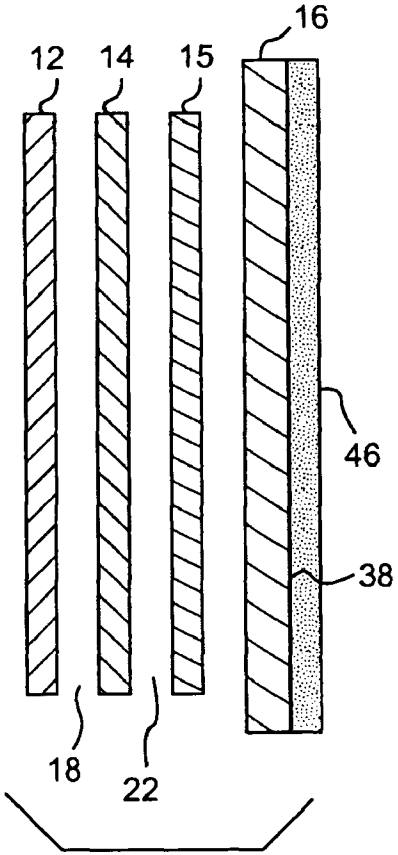
FIG. 10 is a schematic cross-sectional view of an embodiment of the invention where the armor comprising the body of the vehicle is the inner armor plate of the invention and the vehicle includes an interior projectile absorbing layer inside the body.

In a further preferred embodiment the vehicle body includes a layer of sheet armor 46 adjacent the interior surface of the body. As here embodied, and depicted in FIG. 10, the system includes outer armor layer 12, interior armor layer, inner armor layer 14 and interior armor layer 15. The body of the vehicle, here 16 also has a layer of sheet armor 46 adjacent the interior surface of the body. In a further preferred embodiment, this sheet armor 46 comprises a rigid polymer/fiber composite.

Figure 11:
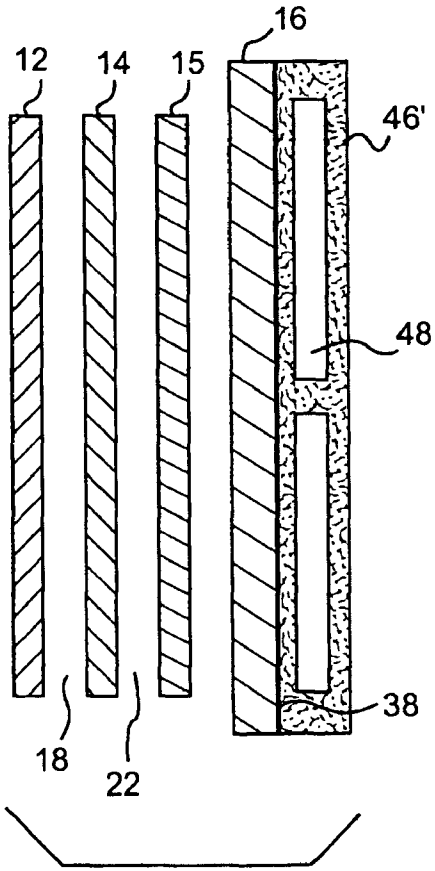
FIG. 11 is a schematic cross-sectional view of an embodiment of the invention where the armor comprising the body of the vehicle is the inner armor plate of the invention and the vehicle includes an interior projectile absorbing layer inside the body of fabric and ceramic plates.

The sheet armor 46 may also comprise a woven fabric comprised of fiber. A still further preferred embodiment includes an interior layer of armor of woven fabric 46' comprised of fiber and a plurality of ceramic plates 48, as schematically depicted in FIG. 11.

Figure 12:
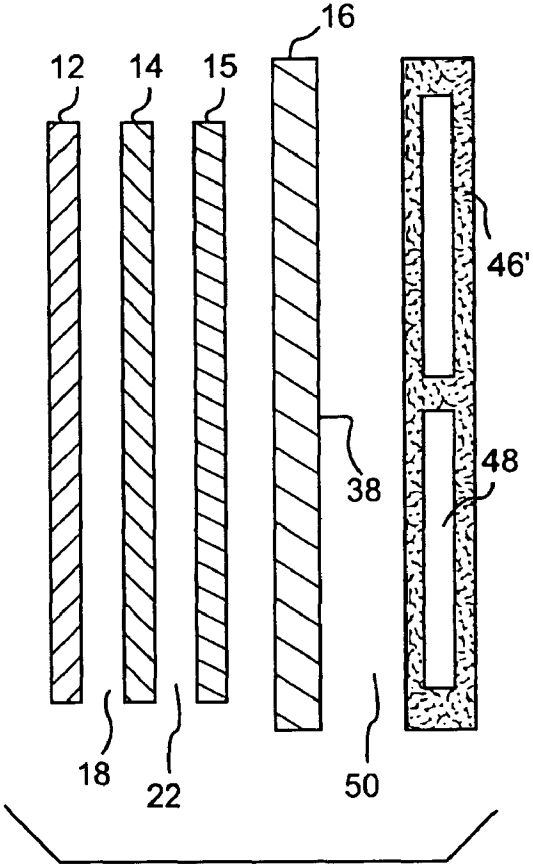
FIG. 12 is a schematic cross-sectional view of an embodiment of the invention where the armor comprising the body of the vehicle is the inner armor plate of the invention and the vehicle includes an interior projectile absorbing layer inside the body of fabric and ceramic plates spaced from the body to form a gap.

In another embodiment, depicted in FIG. 12, the fibrous sheet armor 46' (or the rigid polymer/fiber composite 46, or another layer of metal armor plate (not shown)) adjacent the interior surface of the body 38 is spaced from the interior surface to form a gap 50.

While the present invention provides resistance to solid projectiles, it also provides an opportunity to add protection from elongated solid and liquid projectiles. As disclosed above in the background section there are systems having two layers of armor with an electrical conductor disposed therebetween. An significant electric potential is created between the electrical conductor and the adjacent surfaces of the armor. When a liquid or solid penetrator penetrates the armor it creates an electrically conductive path between the armor layers and the electrical conductor through which the electrical potential is discharged. When there is sufficient electrical energy discharged through the penetrator it is melted or vaporized and its ability to penetrate the next layer of armor is significantly reduced. Because such a system can be readily incorporated into the present invention without significant disadvantage a preferred embodiment of the present invention includes an electrically conductive member disposed in the dispersion space between two adjacent armor plates.

Figure 13:
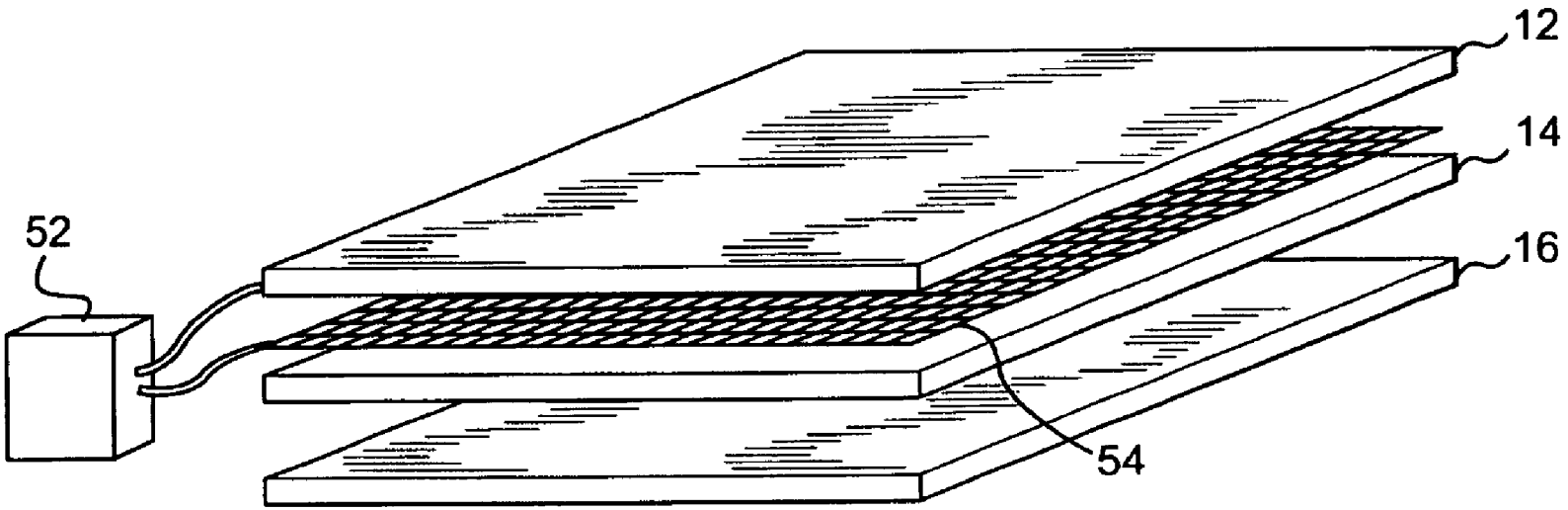
FIG. 13 is a perspective view of one embodiment of the present invention where there is an electrically conductive sheet between the layered armor plates.

As here embodied and depicted in FIG. 13, a source of electrical power 52 is disposed to apply electrical power to either of the two adjacent armor plates (either plate 12 or 14) and the electrically conductive member 54. The source of electrical power supplies sufficient electrical power to disperse at least a portion of an elongated projectile making electrical connection between at least one of the two adjacent armor plates and the electrically conductive member 54.

Figure 14:
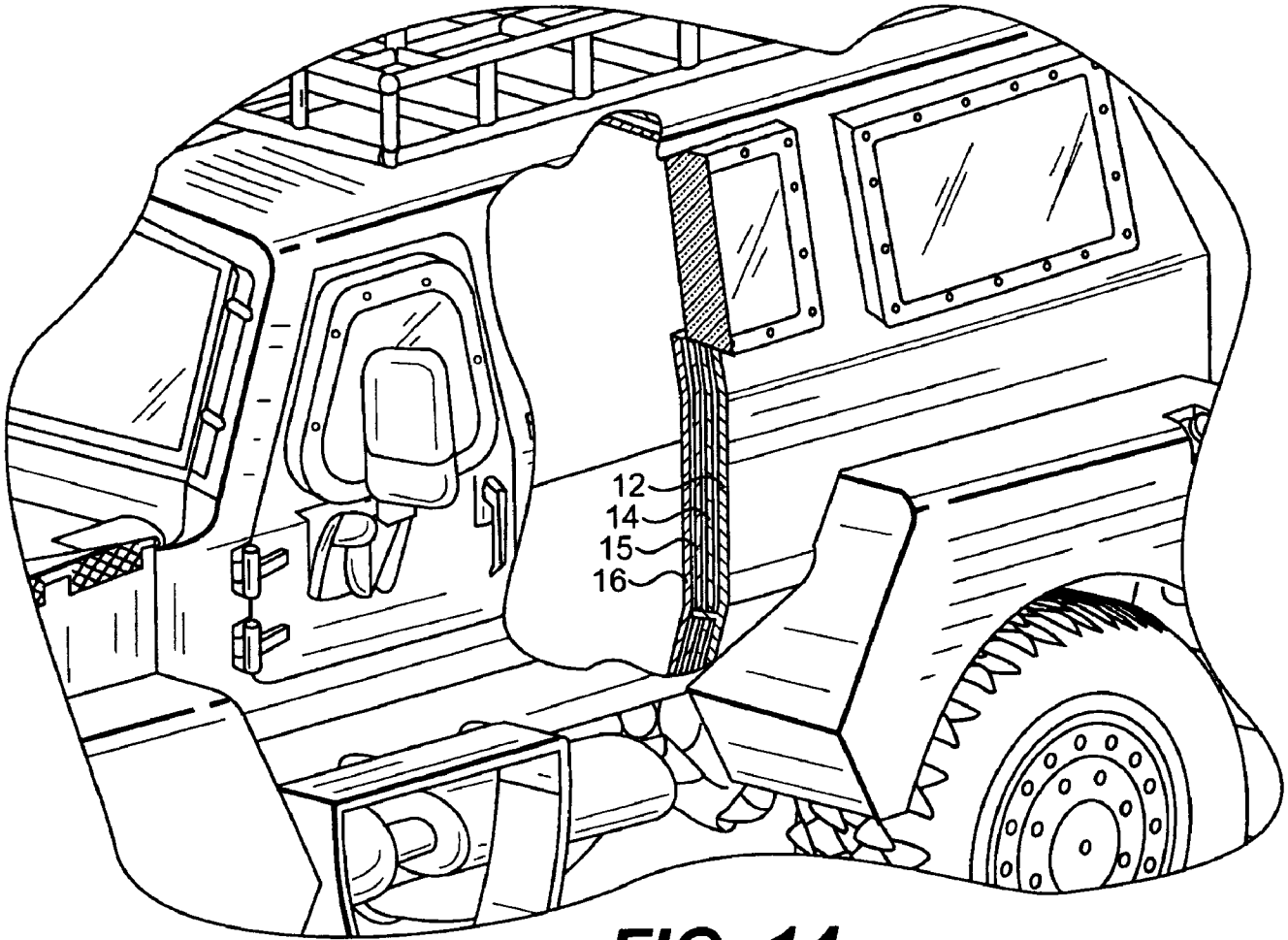
FIG. 14 is a perspective, partial cross-sectional view of an armored vehicle incorporating an embodiment of the invention.

FIG. 14 is a schematic partial cross section of a vehicle that includes one embodiment of the present invention. As shown in FIG. 14 the body of the vehicle includes an interior body member 16 over which are three layers of sheet material, either armor or tough, more ductile sheet material, depicted as outer layer 12, inner layer 14 and interior layer 15. While this embodiment is depicted as an integral part of the vehicle, it could also comprise an add on assembly for enhancing the protection of any desired portion of the vehicle.

EXAMPLE An armor system for defeating a solid projectile was constructed of a series of three aluminum plates. The outermost plate was a Series 7039 aluminum plate 25 mm thick. It was separated from a second interior plate of 25 mm Series 7039 aluminum 100 mm to form a first dispersion space. A third, 25 mm Series 5083 aluminum inner plate was separated from the second interior plate 100 mm. A copper projectile weighing 300 grams was propelled at three plates of an aluminum armor system at a velocity of 2,000 meters/sec. and the array provided over 3 times the protection at one third of the weight of solid RHA needed to stop the penetrator.

It will be apparent to those skilled in the art that various modifications and variations can be made to the present invention. The present invention includes modifications and variations of this invention which fall within the scope of the following claims and their equivalents.

What is claimed is:

1. An armor system for defeating a solid projectile, said system comprising:

a first solid armor plate;

an interior solid armor plate disposed approximately parallel to the first armor plate and displaced therefrom to form a first dispersion space between the first armor plate and the interior armor plate, the first dispersion space being sufficiently thick to allow significant lateral dispersion of material passing though the first dispersion space; and an inner solid armor plate disposed approximately parallel to the interior armor plate and displaced therefrom to form a second dispersion space between the interior armor plate and the inner armor plate, the second dispersion space being sufficiently thick to allow significant lateral dispersion of materials passing therethrough; and wherein at least one of the first, interior, or inner solid armor plates comprises a material having an elongation at tensile rupture of greater than 7% and an ultimate tensile strength greater than 50,000 lbs./in.$^2$; and wherein a plurality of spheres is located in the first dispersion space, the spheres including a material selected from the group of brittle metal, ceramic, and glass.

2. The system of claim 1 wherein the first and the interior armor plates each have an elongation at tensile rupture of greater than 7%.

3. The system of claim 1 wherein the first armor plate consists essentially of a material selected from the group consisting of: a ceramic, an aluminum alloy, a steel alloy, a titanium alloy, a metal matrix composite, and a polymer matrix composite.

4. The system of claim 1 wherein the interior and inner armor plates have an elongation at tensile rupture of greater than 10%.

5. The system of claim 1 wherein the each of the plates are inclined with respect to the anticipated trajectory of the projectile.

6. The system of claim 5 wherein the each of the plates are inclined at an angle of 20° or more with respect to the anticipated trajectory of the projectile.

7. The system of claim 1 wherein said first plate comprises steel having an elongation at tensile rupture of more than 10% and an ultimate tensile strength greater than 50,000 lbs./in.$^2$.

8. The system of claim 1 wherein the spheres are surrounded by a material selected from the group of: a liquid and a gel, said material having a velocity of forced shock greater than 1,000 meters/sec.

9. The system of claim 1 further including an electrically conductive member disposed in the dispersion space between two adjacent armor plates, a source of electrical power disposed to apply electrical power to either of the two adjacent armor plates or the electrically conductive member, the source of electrical power being disposed to supply sufficient electrical power to disperse at least a portion of an elongated projectile making electrical connection between at least one of the two adjacent armor plates and the electrically conductive member.

10. The system of claim 1 where each of the armor plates are comprised of materials having different values for the velocity of a forced shock wave passing therethrough.

11. The system of claim 1 wherein the system is affixed to the exterior of an armored vehicle.

12. The system of claim 11, wherein the vehicle includes a body and the body includes a layer of sheet armor affixed to the interior surface of the body.

13. The system of claim 12, wherein the sheet armor affixed to the interior surface of the body comprises a rigid polymer/fiber composite.

14. The system of claim 12, wherein the sheet armor affixed to the interior surface of the body comprises a woven fabric comprised of fiber.

15. The system of claim 12, wherein the sheet armor affixed to the interior surface of the body comprises a woven fabric comprised of fiber and a plurality of ceramic plates.

16. The system of claim 12, wherein the sheet armor is spaced from the interior surface to form a gap.

17. The system of claim 12, wherein the vehicle is a blast-resistant armored land vehicle having a monocoque body comprised of sheet armor, the body having a bottom portion defining at least one V, with the apex of the V substantially parallel to the centerline of the vehicle.

18. An armor system for defeating a solid projectile, said system comprising:

a first solid armor plate;

an interior solid armor plate disposed approximately parallel to the first armor plate and displaced therefrom to form a first dispersion space between the first armor plate and the interior armor plate, the first dispersion space being sufficiently thick to allow significant lateral dispersion of material passing though the first dispersion space;

an inner solid armor plate disposed approximately parallel to the interior armor plate and displaced therefrom to form a second dispersion space between the interior armor plate and the inner armor plate, the second dispersion space being sufficiently thick to allow significant lateral dispersion of materials passing therethrough; and an outer armor plate, on the outer surface of said first plate, said outer armor plate having an elongation at tensile rupture of less than 5% and an ultimate tensile strength greater than 100,000 lbs./in.$^2$; and wherein at least one of the first, interior, or inner solid armor plates comprises a material having an elongation at tensile rupture of greater than 7% and an ultimate tensile strength greater than 50,000 lbs./in.$^2$.

19. An armor system for defeating a solid projectile, said system comprising:

a first solid armor plate;

an interior solid armor plate disposed approximately parallel to the first armor plate and displaced therefrom to form a first dispersion space between the first armor plate and the interior armor plate, the first dispersion space being sufficiently thick to allow significant lateral dispersion of material passing though the first dispersion space; and an inner solid armor plate disposed approximately parallel to the interior armor plate and displaced therefrom to form a second dispersion space between the interior armor plate and the inner armor plate, the second dispersion space being sufficiently thick to allow significant lateral dispersion of materials passing therethrough; and wherein at least one of the first, interior, or inner solid armor plates comprises a material having an elongation at tensile rupture of greater than 7% and an ultimate tensile strength greater than 50,000 lbs./in.$^2$; and wherein said first plate comprises an aluminum alloy having an elongation at tensile rupture of more than 10% and an ultimate tensile strength greater than 30,000 lbs./in.$^2$.

20. An armor system for defeating a solid projectile, said system comprising:

a first solid armor plate;

an interior solid armor plate disposed approximately parallel to the first armor plate and displaced therefrom to form a first dispersion space between the first armor plate and the interior armor plate, the first dispersion space being sufficiently thick to allow significant lateral dispersion of material passing though the first dispersion space; and an inner solid armor plate disposed approximately parallel to the interior armor plate and displaced therefrom to form a second dispersion space between the interior armor plate and the inner armor plate, the second dispersion space being sufficiently thick to allow significant lateral dispersion of materials passing therethrough; and wherein at least one of the first, interior, or inner solid armor plates comprises a material having an elongation at tensile rupture of greater than 7% and an ultimate tensile strength greater than 50,000 lbs./in.$^2$; and wherein at least one of the first, interior, or inner armor plates has at least one of an outer surface opposite a dispersion space or an inner surface facing a dispersion space, including a plurality of projections on the outer surface or the inner surface, the projections being disposed to at least partially fragment solid projectiles impinging on the outer surface of the armor plate or erupting through the inner surface of the armor plate.

21. The system of claim 20 wherein the surface of the inner armor plate facing the dispersion space includes a plurality of projections on the inner surface, the projections being disposed to disperse solid material impinging on the outer surface of the inner armor plate.

22. An armor system for defeating a solid projectile, said system comprising:

an outer armor plate comprised of an alloy of aluminum having an ultimate tensile strength greater than 30,000 lbs./in.$^2$ and a thickness in the range of from 8 to 40 millimeters;

an interior armor plate comprised of an alloy of aluminum having an ultimate tensile strength greater than 30,000 lbs./in.$^2$ and a thickness in the range of from 8 to 40 millimeters, the interior armor plate being disposed approximately parallel to the outer armor plate and displaced therefrom to form a first dispersion space between the outer armor plate and the interior armor plate a distance of from 25 to 150 millimeters;

an inner armor plate comprised of an alloy of aluminum having an ultimate tensile strength greater than 30,000 lbs./in.$^2$ and a thickness in the range of from 8 to 40 millimeters, the inner armor plate being disposed approximately parallel to the interior armor plate and displaced therefrom to form a second dispersion space between the interior armor plate and the inner armor plate a distance of from 25 to 150 millimeters; and a steel armor plate comprised of an alloy of steel having an elongation at tensile rupture of greater than 10%, the steel armor plate being disposed approximately parallel to the inner armor plate and displaced therefrom to form a third dispersion space between the inner armor plate and the steel armor plate a distance of from 5 to 50 millimeters.

23. The system of claim 22 including a plurality of spheres located in the first dispersion space, the spheres consisting essentially of a material selected from the group of brittle metal, ceramic, and glass.

24. The system of claim 22 including a plurality of spheres located in the second dispersion space, the spheres consisting essentially of a material selected from the group of brittle metal, ceramic, and glass.

25. The system of claim 23 or 24 wherein the spheres are surrounded by a material selected from the group consisting of: a liquid and a gel, said material having a velocity of forced shock greater than 1,000 meters/sec.

26. The system of claim 22 further including an electrically conductive member disposed in the dispersion space between two adjacent armor plates, a source of electrical power disposed to apply electrical power to either of the two adjacent armor plates or the electrically conductive member, the source of electrical power being disposed to supply sufficient electrical power to disperse at least a portion of an elongated projectile making electrical connection between at least one of the two adjacent armor plates and the electrically conductive member.

27. The system of claim 22 wherein the system is affixed to the exterior of an armored vehicle wherein the body of the armored vehicle comprises the steel armor layer.

28. The system of claim 27, wherein the vehicle includes a body and the body includes a layer of sheet armor adjacent the interior surface of the body.

29. The system of claim 27, wherein the sheet armor adjacent the interior surface of the body comprises a rigid polymer/fiber composite.

30. The system of claim 27, wherein the sheet armor adjacent the interior surface of the body comprises a woven fabric comprised of fiber.

31. The system of claim 27, wherein the sheet armor adjacent the interior surface of the body comprises a woven fabric comprised of fiber and a plurality of ceramic plates.

32. The system of claim 27, wherein the sheet armor adjacent the interior surface of the body is spaced from the interior surface to form a gap.

33. The system of claim 27, wherein the vehicle is a blast-resistant armored land vehicle having a monocoque body comprised of steel sheet armor, the body having a bottom portion defining at least one V, with the apex of the V substantially parallel to the centerline of the vehicle.

* * * * *